United States Patent [19]

Davis

[11] 4,071,596

[45] Jan. 31, 1978

[54] PROCESS FOR MAKING HIGH SHRINKAGE ACRYLIC FIBERS

[75] Inventor: Merton Louis Davis, Camden, S.C.

[73] Assignee: E. I. Du Pont de Nemours and Company, Wilmington, Del.

[21] Appl. No.: 743,674

[22] Filed: Nov. 22, 1976

Related U.S. Application Data

[63] Continuation of Ser. No. 588,610, June 20, 1975, Pat. No. 4,011,294, which is a continuation-in-part of Ser. No. 481,374, June 18, 1974, abandoned.

[51] Int. Cl.[2] ..... D01F 6/18

[52] U.S. Cl. ..... 264/168; 264/206; 264/210 F

[58] Field of Search ..... 264/168, 206, 210 F

[56] References Cited

U.S. PATENT DOCUMENTS

| | | | |
|---|---|---|---|
| 3,180,913 | 4/1965 | Veith et al. | 264/290 |
| 3,330,898 | 7/1967 | Hurley et al. | 264/182 |
| 3,784,666 | 1/1974 | Sekiguchi et al. | 264/182 |
| 3,828,014 | 8/1974 | Wieden et al. | 264/206 |

*Primary Examiner*—Jay H. Woo

[57] ABSTRACT

High-shrinkage acrylonitrile polymer fibers that shrink with unusually high shrinkage force are prepared by a process in which as-spun, dry-spun filaments are extracted to remove solvent by passing the filaments continuously through aqueous baths at 63° to 75° C., drawn between 1.5X and 3.5X during passage through the baths, and cooled to a temperature below 50° C. while free of tension. The filaments are further drawn 1.1X to 1.5X while passing continuously through at least one aqueous bath at 70° to 80° C. and are then dried at a temperature no higher than 60° C. The filaments may be crimped at 55° to 65° C. in a stuffer box prior to drying. The filaments may be cut to staple fibers for use in pile fabrics; they are particularly useful in preparing artificial furs.

4 Claims, No Drawings

PROCESS FOR MAKING HIGH SHRINKAGE ACRYLIC FIBERS

REFERENCE TO RELATED APPLICATION

This is a continuation-in-part of copending application Ser. No. 588,610 filed June 20, 1975 now U.S. Pat. No. 4,011,294 which in turn is a continuation-in-part of application Ser. No. 481,374 filed June 18, 1974, now abandoned.

This invention relates to a process for making high shrinkage fibers from a tow of dry-spun acrylonitrile polymer filaments, i.e., acrylic filaments. More particularly, it relates to a process for making high shrinkage fibers characterized by a high level of shrinkage force, and to the acrylic fibers so produced.

In the production of pile fabrics to be used for artificial furs of two or more pile heights, a mixture of low-shrinkage fibers and high-shrinkage fibers is employed. When the pile fabric is heated, the high shrinkage fibers shrink to simulate the underfur, giving a dense pile close to the base fabric. The low-shrinkage fibers, which are also usually of higher denier, simulate the longer guard hairs. Acrylonitrile polymer fibers of high shrinkage, on the order of 28–30% and higher, are especially useful for the underfur, because they possess tactile aesthetics similar to the natural animal fibers.

The production of high shrinkage acrylic fibers from dry-spun acrylic filaments has been disclosed by Wieden in U.S. Pat. Nos. 3,739,054 and 3,828,014, and by Davis in U.S. Pat. No. 3,097,415. However, each of these processes involves a preliminary treatment in which the dry-spun filaments are heated with steam under pressure or dried at temperatures of 100° C. or above. A more practical process has been desired; especially, one suited to high-speed handling of large numbers of filaments in the form of a rope or tow.

SUMMARY OF THE INVENTION

In accordance with the present invention, a simplified process has been found for making high-shrinkage acrylonitrile polymer fibers which are also characterized by an unusually high shrinkage force and more rapid development of tension with increasing temperature. These properties are important to fibers used to prepare mixed-shrinkage furs, since fibers having higher shrinkage force are better able to pull through a mass of fibers which do not have the same shrinkage. The high-shrinkage fibers with high shrinkage force can be provided either in dyed or undyed form. The fibers are produced by a novel process involving a wash-draw step characterized by critical bath temperatures, followed by the steps of cooling and drying under specified conditions. More particularly, the wash-drawn filaments are cooled in the relaxed state (i.e., free of tension) and then subjected to a second wash-draw step at critical bath temperatures prior to drying at a low temperature. The filaments may be crimped at a low temperature prior to drying and, if desired, cut to staple fibers before or after drying.

This invention is an improvement over previous processes wherein as-spun, dry-spun filaments of acrylonitrile polymer are extracted to remove solvent by passing the filaments continuously through aqueous baths, drawn between 1.5× and 3.5× during passage through the baths and thereafter dried. In accordance with the improvement the as-spun filaments, prior to other treatment, are passed through the aqueous baths at bath temperatures of 63° to 75° C. and then, without intermediate treatment, the filaments are cooled in a condition free to relax to a temperature below 50° C., then passed continuously through at least one aqueous bath at a temperature of 70° to 80° C. while further drawing them between 1.1× and 1.5×, and dried at a temperature no higher than 60° C.

The present invention is a two-pass wash-draw process in which the filaments are first drawn 1.5× - 3.5× (preferably 1.5 - 2.5×) at 63°-75° C and then cooled while free of tension to a temperature of less than 50° C (preferably less than 40° C) after which they are further drawn 1.1× - 1.5× while passing them continuously through at least one aqueous bath at a temperature of 70° to 80° C and dried at a temperature no higher than 60° C (preferably at a temperature no higher than 50° C). The temperature in the second pass drawing step is preferably higher (preferably at least 5° C higher) than in the first drawing step. It will usually be desirable to crimp the filaments in a stuffer box crimper at a temperature in the range 55°-65° C, prior to drying. For use in pile fabrics the filaments are cut to staple fibers in conventional manner.

In this process, the filaments are preferably drawn at a draw ratio of 1.3× to 1.4× while passing continuously through at least one aqueous bath at a temperature of 73° to 76° C, in the second drawing step.

Aqueous baths to which no coloring matter has been added may be employed in the process to produce white (colorless) products; and dyed fibers may be produced by employing a liquid dye mixture as the bath in which the first drawing step is carried out, with aqueous washing occurring in the second draw bath.

The product of the invention, produced by the process described above, is a high-shrinkage acrylonitrile polymer fiber having a high shrinkage force. The shrinkage of the dry product is at least 28%, preferably at least 30%, a desirable range being 30 to 40%. The shrinkage tension in grams per denier increases at a rate of at least 0.0035 per degree centigrade when heated at a rate of 20° C. per minute in an oven. The polymer structure, when evaluated by X-ray diffraction measurements, is characterized by a molecular orientation of about 32 ± 4%, a crystallite size of about 53 ± 1.5 Angstroms, and high microporosity as indicated by X-ray porosity index values of at least 40 in the void size range of 45 to 90A and at least 50 in the void size range of 90 to 140A. Fibers of about 3 to 4 denier having about 8 to 10 crimps per inch are particularly useful for preparing artificial furs.

DESCRIPTION OF THE INVENTION

The acrylonitrile polymer filaments used to prepare the product of the invention are dry-spun filaments, formed by spinning a solution of acrylonitrile polymer in a solvent for the polymer, such as dimethylformamide, dimethylacetamide, or dimethylsulfoxide. The solution is heated and extruded through spinnerets into a hot inert gas where most of the spinning solvent vaporizes. The filaments so spun normally contain from about 10 to 30% of the spinning solvent, based on the weight of the filaments, and usually 20% or more. After the filaments are spun they are collected in ropes or tows containing at least 10,000 filaments and up to 500,000 filaments. The tows (or ropes) are then moistened; usually about 20–75% water is applied, based on the dry weight of the tow. If desired, an amount of water equal to or even slightly greater than the dry weight of the tow can be applied.

The process of the invention is carried out in conventional wash-draw apparatus such as the equipment described by Davis et al. in U.S. Pat. No. 3,124,631. The equipment basically comprises a series of tanks or reservoirs, usually 10 in number, although the number is not critical. In the process of the invention, a rope or tow of the filaments is passed at least once through the wash-draw equipment. During this pass, the first several tanks are employed to extract spinning solvent from the filaments while they are subjected to a nominal draw of up to about 1.2× to take up the slack in the filaments and keep them taut. Most of the draw applied to the filaments in imposed in the final few tanks, the total draw during the first pass amounting to a draw ratio between about 1.5 and 3.5× (preferably 1.5 - 2.5×). The aqueous baths in the tanks are maintained at a temperature in the range of 63°-75° C. during this pass. The aqueous wash medium is usually water alone, although other additives may be present. If it is not desired to dye the filaments, the aqueous wash medium is normally fed to the last tank in the wash-draw apparatus and the aqueous wash medium then cascades from tank to tank to the first tank, from which it is withdrawn. However, if it is desired to dye the filaments in the process, the aqueous dye mixture is fed to the last tank at a rate sufficient to replace the dye mixture carried out by the filaments and cascaded back to about the eighth tank. Aqueous wash medium is added to the next preceding tank and withdrawn from the first tank, at which point it contains an appreciable concentration of extracted spinning solvent.

In accordance with the invention, the filaments which have been washed and drawn by passing them through the wash-draw apparatus are cooled in the relaxed state and then subjected to a second wash-draw step followed by drying at a low temperature.

The filaments which have been washed and drawn in the first pass through the wash-draw apparatus are cooled in a condition free to relax. This may be accomplished simply by depositing the wash-drawn filaments, usually in rope or tow form, in a collection can. Before additional treatment the filaments should be allowed to stand long enough to become cooled to below 50° C, preferably to below 40° C. The cooled filaments are then passed again through the wash-draw apparatus. In the second pass the aqueous medium is maintained at a temperature within the temperature range of 70–80° C, the bath temperature being at least 5° higher than the bath temperature in the first pass. The filaments are drawn at a draw ratio of 1.1 - 1.5× during the second pass, the stretch normally being applied rather uniformly throughout the apparatus. In the second pass the aqueous medium is normally fed to the last tank and withdrawn from the first tank. Additional spinning solvent is extracted from the filaments by the aqueous medium, and if the filaments have been dyed, any dye not absorbed by the filaments is also rinsed off in this step.

After the filaments have been subjected to two stages of drawing in the wash-draw apparatus, they are crimped and then dried at temperatures no higher than 60° C. If desired, the filaments may be cooled under tension after the second pass wash-draw and reheated prior to crimping. Drying is suitably carried out by passing the filaments through a hot air oven on a conveyor belt. The filaments may be cut to staple fibers either before or after being dried.

In a highly preferred embodiment of the process, the second drawing step is carried out by passing the filaments through an aqueous bath having a temperature in the range of 73°-76° C. at a draw ratio of 1.3 to 1.4×. In accordance with the invention, it has been found that maximum shrinkage of the filaments in their final dried form is dependent upon carrying out the process within this narrow temperature and draw ratio range.

The acrylonitrile polymers used to make the fibers employed in this invention are defined as long chain synthetic polymers composed of acrylonitrile units of the formula $$\left(CH_2-\underset{\underset{CN}{|}}{CH_2}\right)$$

in the polymer chain. As is well understood, the term includes the homopolymer of acrylonitrile (i.e., polyacrylonitrile) and copolymers of at least 60% by weight of acrylonitrile and one or more suitably monoethylenically unsaturated monomers copolymerizable with acrylonitrile. Among the typical addition monomers exemplary of those which are copolymerizable with polyacrylinitrile are methyl acrylate, methyl methacrylate, vinyl acetate, styrene, methacrylamide, methacrylonitrile, vinyl chloride, vinyl bromide, vinylidene chloride, methyl vinyl ketone and the like as well as any of the available vinyl pyridines. The preferred comonomers include methyl acrylate, vinyl acetate, vinyl chloride, styrene, and the vinyl pyridines. Sulfonate comonomers can also be employed, e.g., the sulfonated styrenes, vinyl sulfonate, sulfonate, methallyl sulfonate and their alkali-metal or alkaline-earth-metal salts, and the like; it being necessary only that the compound chosen from this class be copolymerizable with acrylonitrile to the desired extent. The preferred sulfonate comonomers are the sulfonated styrenes.

The dyes useful in dyeing the filaments of acrylonitrile polymer must be soluble in a suitable solvent therefor, or at least dispersible in the solvent. Dyes having a particle size of not more than 100A are readily imbibed in an acrylonitrile polymer filament. The term "liquid dye mixture" is limited to those classes of mixtures. A suitable solvent for many dyes is a mixture of glycollic acid and water. The dyes may be selected from any of a wide number of dyestuff classes. Preferably, the dye chosen for the use is substantive to the acrylonitrile polymer substrate of the particular filaments which are being spun and drawn.

MEASUREMENTS AND TESTS

Temperature-Tension Spectra

The tension exerted by fibers upon heating is determined by running a tension-temperature spectrum of a sample of the fibers. The values reported in the examples below are determined in accordance with the following procedure. Sufficient filaments, from a sample of rope from which the staple fibers are cut, are aligned to make a sample of about 100–200 denier. The filaments are cut to a length of 36 cm., handling the filaments carefully so that they do not become stretched. The filaments are gathered together into a strand and the strand is tied in a loop and weighed. The loop of the fiber sample to be tested is placed in an oven consisting of the vertical leg of an inductively heated D-shaped aluminum tube having an inside diameter of 0.25 inch and having openings at the top and bottom of the vertical leg. The top of the loop is fastened in a clamp attached to a transducer (commercially available as a Stratham transducer, operating on the Wheatstone Bridge principle). The bottom of the loop is fastened to another clamp which elongates the fiber strand by means of an adjusting screw to a calibrated tension of 2 milligrams per denier, based on the loop denier (twice the denier of the straight sample from which the loop is formed). The temperature of the oven and the tension measured by the transducer are continuously and automatically recorded on a chart using conventional, commercially available instrumentation. The oven is heated at the rate of 20° C. per minute and a curve showing the tension of the fiber with respest to a temperature as it is heated is continuously recorded. From the slope of curve the shrinkage force in gm./den./° C. is calculated, and the temperature at maximum tension is also reported.

X-Ray Parameters

Molecular orientation, crystallite size, and porosity indices are obtained from X-ray diffraction measurements made in a conventional manner. [For example, generally as described by Statton in A.S.T.M. Spec. Tech. Bull. No. 247 (1958)].

Fiber test samples of about ½ gm. are uniformly mounted between two stainless steel cards (1¼ × 1¼ × 1/32 inch) with a ¾ inch diameter aperture. The thus arranged specimen is mounted in the spinning or stepped rotation holder of the diffractometer. Thus, the wide angle, crystalline, diffraction pattern is used for measuring orientation and crystallite size and the small angle scattering for porosity. Commercial Philips Electronic Instruments Co. instrumentation is used to provide and make the required intensity measurements on the X-ray diffraction patterns. The X-ray source comprises a copper target with 40KV, 20 ma power supply. The monochromator employs ¼° divergence and receiving slits along with a 1° pre-slit and a graphite crystal.

Measurements of diffracted radiation intensity are made by means of a scintillation counter with pulse height analyzer. Determinations of intensity are made in terms of the reciprocal of the time required for a specified number (usually 10,000) of counts for each angular position. For determining the porosity indices, intensity is determined at discrete diffraction angle ($2\theta$) steps of ¼° from a value of $2\theta$ of ¾° to 1° for the 90–140A index, 1° to 2° for the 45–90A index, 2° to 6° for the 15–45A index, and 6° to 11° for the 8–15A index. For determining crystallite size, intensity is determined in $2\theta$ angle steps of ¼° from 6° to 36°. The intensity values for the 6° to 36° range are also used for normalizing computations. For orientation measurements., intensity is determined at azimuthal ($\psi$) angle intervals of 2.25° extending from 0° through 180° for a constant, preselected, $2\theta$ value equal to 16.8°.

Raw intensity values are corrected by subtracting air and electronic noise background. The raw air background values are first corrected by multiplying by sample transparency values before then subtracting. In addition normalized corrected intensity values are computed in order to correct for small variations in the amount of sample in the beam. This is accomplished by multiplying by a factor found necessary to achieve a value of 1 for the integrated area under the corrected intensity versus $2\theta$ curve from $2\theta$ equal to 6° to 36°. Sample transparency, the zero ($2\theta$) angle intensity reduction, is determined by using nine Ni filters each 0.0007 inch thick and measuring beam intensity with and without the sample for 400 sec. as I and $I_o$ respectively. Transparency values are then computed as the ratio $I/I_o$.

Crystallite size is computed from the normalized corrected intensity vs. diffraction angle data according to the equation:

$$\text{Crystallite size} = \frac{0.9\,\lambda}{B_{\frac{1}{2}}\cos\theta} = \frac{80.4}{B_{\frac{1}{2}}}$$

when $2\theta = 16.8°$, $\lambda = 1.5418$ for $CuK_\alpha$ radiation, and $B_{1/2}$ is the half-width of the crystalline diffraction peak. The value of $B_{1/2}$ is obtained from the corrected intensity vs. $2\theta$ curve by first determining the total area, A, under the crystalline diffraction peak at $2\theta = 16.8°$ after subtracting out all contributions to the area from amorphous scattering. The value of A/2 is computed and then the width, $B_{1/2}$ in degrees, of the selected intensity peak, is found symmetrically around the peak so that the area under the peak confined by this width is equal to A/2. No instrumental broadening correction is made in this method. The crystallite size calculated for acrylonitrile polymer by this method refers to a direction perpendicular to the molecular axes, i.e., the average crystallite width, and therefore defines the degree of crystalline perfection across polyacrylonitrile chains.

Molecular orientation is computed from the azimuthal intensity variations curve according to the equation: Orientation $$(\%) = 100\left(\frac{90 - d\,\Psi\,A/2.}{90}\right)$$

The value of $d\psi$ A/2. is obtained from the corrected intensity vs. $\psi$ curve by first determining the total area, A, under the curve, computing the value A/2, and then finding that width, $d\psi$ A/2 in degrees, of the intensity peak selected, symmetrically around the peak, so that the area under the peak confined by this width is equal to A/2.

The four porosity indices are computed from the normalized corrected intensity vs. diffraction angle data according to the following expressions:

$$P(8\text{–}15A) = 100 \times \text{Area}\ (2\theta = 6° \text{ to } 11°)$$

$$P(15\text{–}45A) = 100 \times \text{Area}\ (2\theta = 2° \text{ to } 6°)$$

$$P(45\text{–}90A) = 100 \times \text{Area}\ (2\theta = 1° \text{ to } 2°)$$

$$P(90\text{–}140A) = 100 \times \text{Area}\ (2\theta = \tfrac{3}{4}° \text{ to } 1°).$$

Thus these indices are indicative of the relative number of pores (inhomogeneities) which contribute to the X-ray scattering over a certain range of the intensity vs. $2\theta$ curve.

"Elongation" and "tenacity" are measured by the Instron tester in accord with ASTM D-540-64 after the filaments have been conditioned as per ASTM D-1776.

"Shrinkage" refers to the reduction in length of a bundle of at least 100 parallel filaments having a length of 50 to 100 cm. after immersion in boiling water for 10 minutes. Percent shrinkage is calculated as $$\frac{L_o - L_b}{L_o} \times 100$$

wherein $L_o$ is the length of filaments before immersion in boiling water and $L_b$ is the length of the filaments after 10 minutes immersion in boiling water.

The invention will be further illustrated by the following examples.

EXAMPLE I

Acrylonitrile polymer filaments are prepared by dry-spinning, at a cell exit speed of 400 ypm, a 31.6 wt. % dimethylformamide solution of a terpolymer containing 94% by weight acrylonitrile, 5.7% methyl acrylate, and 0.3% sodium styrenesulfonate. The filaments, which contain 26% dimethylformamide, are collected in the form of a rope containing about 50,000 individual filaments having an as-spun denier of 6.1. The rope is fed at a speed of 200 ypm continuously through a wash-draw apparatus comprising ten tanks and is taken up at the exit of the apparatus at a speed of 420 ypm. In the first seven tanks of the apparatus, the rope is passed through a flow of countercurrent water at 68° C. with a draw amounting to 1.15× over the seven tanks to keep the filaments taut. The last three tanks in the apparatus contain a solution of a brown dye formulation at a concentration of 1.6% and a temperature of 68° C. The brown dye formulation consists of 42.6% of the yellow dye having the formulation 1,3,-3-trimethyl-2-[(methyl phenyl hydrazono) methyl]-3H-indolium sulfate and the following amounts of dye having the Color Index identifications: 32.1% Basic Red 14, 6.4% Basic Blue 3, and 18.9% Basic Green 4. A draw ratio of 1.83× is applied across the last three tanks, applied evenly from tank to tank, and the total draw ratio applied across all 10 tanks is accordingly 2.1×. After leaving the 10th tank, the drawn, dyed rope is deposited in a collection can. Fibers cut from the rope are found to contain 1.46% dye on fiber (based on dry weight) and less than 5% dimethylformamide.

The dyed rope collected in the can is allowed to cool for more than one hour until it cools to below 50° C. Two ends of the rope are continuously withdrawn from the can and passed at a speed of 200 ypm into a second 10-tank wash-draw apparatus. In this second apparatus the rope is continuously rinsed with a countercurrent flow of water at 75° C. The rope is withdrawn from the apparatus at a speed of 260 ypm for an imposed draw ratio of 1.3×, applied uniformly throughout the tank. As the rope leaves the last tank of the wash-draw apparatus, an antistatic finish is then applied by passing the rope over a finish roll and the rope is then passed into a conventional stuffer box crimper wherein the filaments are crimped at a temperature of 60° C. The rinsed, crimped, wet rope is analyzed and found to contain less than 1% by weight of dimethylformamide. The wet rope has a shrinkage in boiling water of 38.6%.

The wet rope is then dried at 55° C. on a conveyor belt dryer for 15 minutes and is then cut to staple having a 1.5-inch cut length. The dried staple is found to shrink 31.4% in boiling water and has a denier per filament of 3.1.

The properties and structural parameters of the high-shrinkage, dark brown staple fibers are shown in Table I.

EXAMPLE II

Acrylonitrile polymer filaments are spun, extracted, dyed, and drawn in two passes through a wash-draw apparatus according to the procedure described in Example I, except that the brown dye formation is replaced by a beige dye formulation at a concentration of 0.2% and a temperature of 68° C. The beige dye formulation consists of 50.2% of the yellow dye having the formulation 1,3,3-trimethyl-2-[(methyl phenyl hydrazono) methyl]-3H-indolium sulfate and the following amounts of dye having the Color Index identifications: 19.3% Basic Red 14, and 30.5% Basic Blue 77. Fibers cut from the rope after the first pass through the wash-draw apparatus are found to contain 0.23% dye on fiber (based on dry weight). After the second pass through the wash-draw apparatus, the wet rope has a shrinkage in boiling water of 38.5%. The cut staple fibers, after being dried at 55° C., have a shrinkage of 31.6% in boiling water.

The properties and structural parameters of the high-shrinkage, light beige staple fibers are shown in Table I.

COMPARATIVE EXAMPLE IIA

Example II is repeated, except that the temperature of the countercurrent water and dye baths in the first-pass wash-draw step is 70° C. instead of 68° C.; and with the significant additional difference that the lag between the first-pass and second-pass wash-draw steps is insufficient to cool the tow below 50° C., the temperature of the tow being about 55–60° C. when fed to the second-pass wash-draw step. The properties and structural parameters of the light beige staple fibers are listed in Table I. As shown in the table, the shrinkage of this product is 27.2% and the shrinkage force is 0.00323, which is not regarded as sufficient for use in making high quality artificial furs.

EXAMPLE III

Acrylonitrile polymer filaments are spun, extracted, dyed, and drawn according to the procedure described in Example I in a two-pass process through the wash-draw apparatus; except that the brown dye formulation is replaced by a black dye formulation at a concentration of 8.25% and a temperature of 68° C. The black dye formulation consists of 22% of the yellow dye having the formulation 1,3,3-trimethyl-2-[(methyl phenyl hydrazono) methyl]-3H-indolium sulfate and the following amounts of dyes having the Color Index identifications: 26.4% Basic Red 14, 4.9% Basic Blue 3, and 46.2% Basic Green 4. Fibers cut from the rope after the first pass through the wash-draw apparatus are found to contain 4.0% dye on fiber (based on dry weight). After the second pass through the wash-draw apparatus, the wet rope has a shrinkage in boiling water of 38.7%. When the wet rope is dried at 55° C. for 15 minutes and is cut to staple fibers having a 1.5-inch cut length, the dried staple is found to shrink 32.5% in boiling water.

The properties and structural parameters of the high-shrinkage, black staple fibers are shown in Table I.

TABLE I

PROPERTIES OF PRODUCTS OF THE INVENTION AND COMPARATIVE PRODUCTS

| Properties | Fiber of Ex. I | Ex. II | Comparative Ex. IIA | Ex. III |
|---|---|---|---|---|
| Wet Rope Shrinkage | 38.6% | 38.5% | 37.9% | 38.7% |
| Dry Fiber Shrinkage | 31.4% | 31.6% | 27.2% | 32.5% |
| Temp.-Tension Spectrum | | | | |
| Shrinkage Force (gm./den./° C) | 0.00375 | 0.00419 | 0.00323 | 0.00530 |
| Max. Tension (gm./den.) | 0.0428 | 0.0406 | 0.0625 | 0.0536 |
| Temp. at Max. Tension (° C) | 103 | 102 | 98 | 103 |
| X-Ray Properties | | | | |
| Crystallite Size, A | 52.0 | 54.1 | 53.1 | 53.9 |
| Orientation, % | 32.1 | 33.1 | 29.8 | 30.9 |
| Microvoid Comp. | | | | |
| 8–15A | 4.8 | 6.2 | 5.3 | 4.8 |
| 15–45A | 9.9 | 17.2 | 8.0 | 11.1 |
| 45–90A | 41.5 | 52.0 | 25.1 | 44.0 |
| 90–140A | 56.3 | 67.9 | 29.2 | 59.5 |

EXAMPLE IV

Acrylonitrile polymer filaments are spun, collected in the form of rope, and given a first pass through a wash-draw apparatus following the procedure and conditions described in Example I, except that no dye is added to the last three tanks. The drawn rope deposited in the collection can, after a lapse of more than 1 hour during which it cools to below 50° C., is continuously withdrawn from the can and passed into a second 10-tank wash-draw apparatus at a speed of 200 ypm. In a series of tests, the rope is continuously rinsed in this second apparatus with a countercurrent flow of water at various temperatures, after which it is withdrawn from the apparatus at a speed of 260 ypm. As the rope leaves the last tank of the wash-draw apparatus, an antistatic finish is applied by passing the rope over a finish roll and the rope is then passed into a conventional stuffer box crimper wherein the filaments are crimped at a temperature of 58° C. The wet rope is dried at 55° C. on a conveyor belt dryer for 15 minutes and is then cut to staple having a 1.5-inch cut length. The temperatures of the countercurrent water used in the second pass in the various tests, as well as the shrinkages of the wet rope and dry rope and other product parameters, are listed in Table II.

Surprisingly, although the wet rope shrinkage rises continuously as the temperature of the second pass rinse water decreases, the dry rope shrinkage rises to a maximum and then decreases. The optimum dry rope shrinkage is obtained when the second pass rinse water temperature is about 74° C.

EXAMPLE V

Acrylonitrile polymer filaments are spun, collected in the form of rope, and given a first pass through a wash-draw apparatus following the procedure and conditions described in Example I, except that no dye is added to the last three tanks. The drawn rope described in the collection can, after a lapse of more than 1 hour during which it cools to below 50° C., is continuously withdrawn from the can and passed into a second 10-tank wash-draw apparatus at an input speed adjusted in a series of tests to yield various desired draw ratios. The rope is continuously rinsed in the second apparatus with a countercurrent flow of water at 70° C., after which it is withdrawn from the apparatus at a speed of 260 ypm. As the rope leaves the last tank of the wash-draw apparatus, an antistatic finish is applied by passing the rope over a finish roll and the rope is then passed into a conventional stuffer box crimper wherein the filaments are crimped at a temperature of 58° C. The wet rope is dried at 55° C. on a conveyor belt dryer for 15 minutes and is then cut to staple having a 1.5-inch cut length. The various draw ratios used in the second pass in the various tests, as well as the dry rope shrinkage and dry rope denier per filament and other product parameters, are listed in Table III.

This example illustrates that the preferred second pass draw ratio is about 1.3 – 1.4×.

TABLE II

Properties of Fibers Drawn at Various Temperatures in Second Pass Wash-Draw

| Test | Temp. of 2nd Pass Rinse Water (° C.) | Wet Rope Shrinkage (%) | Dry Rope Shrinkage (%) | Temp.-Tension Spectrum: Shrinkage Force (gm./den./° C.) | Temp.-Tension Spectrum: Max Tension (gm./den.) | Crystallite Size, A | Microvoid Composition 8–15A | 15–45A | 45–90A | 90–140A |
|---|---|---|---|---|---|---|---|---|---|---|
| A | 80 | 36.0 | 28.6 | 0.0054 | 0.0521 | 54.3 | 5.4 | 12.7 | 47.5 | 61.4 |
| B | 75 | 40.2 | 32.2 | 0.0065 | 0.0588 | 53.7 | 6.0 | 16.9 | 65.4 | 86.7 |
| C | 70 | 41.6 | 29.9 | 0.0074 | 0.0500 | 52.1 | 6.2 | 19.1 | 75.5 | 98.3 |
| D | 65 | 44.8 | 29.3 | 0.0031 | 0.0310 | 48.1 | 5.9 | 7.9 | 26.4 | 34.6 |

TABLE III

Properties of Fibers Drawn at Various Draw Ratios in Second Pass Wash-Draw

| Test | 2nd Pass Draw Ratio | Dry Rope Shrinkage (%) | Dry Rope Denier Per Filament | Temp.-Tension Sepctrum: Shrinkage Force (gm./den./° C.) | Temp.-Tension Sepctrum: Max Tension (gm./den.) | Crystallite Size, A | Microvoid Composition 8–15A | 15–45A | 45–90A | 90–140A |
|---|---|---|---|---|---|---|---|---|---|---|
| A | 1.15X | 33.0 | 3.53 | 0.0066 | 0.0565 | 54.0 | 6.0 | 25.7 | 104.0 | 131.7 |
| B | 1.25X | 33.5 | 3.13 | 0.0070 | 0.0625 | 53.4 | 5.7 | 16.1 | 63.7 | 84.0 |

TABLE III-continued

Properties of Fibers Drawn at Various Draw Ratios in Second Pass Wash-Draw

| Test | 2nd Pass Draw Ratio | Dry Rope Shrinkage (%) | Dry Rope Denier Per Filament | Temp.-Tension Sepctrum Shrinkage Force (gm./den./° C.) | Temp.-Tension Sepctrum Max Tension (gm./den.) | Crystallite Size, A | Microvoid Composition 8-15A | 15-45A | 45-90A | 90-140A |
|---|---|---|---|---|---|---|---|---|---|---|
| C | 1.35X | 35.2 | 3.06 | 0.0074 | 0.0500 | 52.1 | 6.2 | 19.1 | 75.5 | 98.3 |
| D | 1.45X | 33.2 | 2.75 | 0.0043 | 0.0305 | 48.5 | 5.6 | 8.3 | 26.7 | 37.0 |

I claim:

1. In the process of preparing acrylic fibers wherein as-spun, dry-spun filaments of acrylonitrile polymers are extracted to remove solvent by passing the filaments continuously through aqueous baths, drawn between 1.5 and 3.5× during passage through the baths and thereafter dried; the improvement for preparing high shrinkage fibers having high shrinkage force which comprises passing the as-spun filaments through the aqueous baths in which they are drawn at bath temperatures of 63° to 75° C and then cooling the filaments in a condition free to relax to a temperature below 50° C, then passing the filaments continuously through at least one aqueous bath at a temperature of 70° to 80° C while further drawing the filaments between 1.1× and 1.5× and then drying the filaments at a temperature no higher than 60° C.

2. The process defined in claim 1 wherein the filaments are drawn 1.5× to 2.5× during passage through the aqueous bath at 63° to 75° C.

3. The process defined in claim 2 wherein the temperature in the second drawing step is at least 5° C higher than in the first drawing step.

4. The process defined in claim 2 wherein the temperature in the second drawing step is 73° to 76° C, which is higher than in the first drawing step, the draw ratio is 1.3× to 1.4× and the filaments are then crimped at 55° to 65° C in a stuffer box crimper and dried at a temperature no higher than 60° C.

* * * * *